US008511801B2

(12) United States Patent
de Vreede et al.

(10) Patent No.: US 8,511,801 B2
(45) Date of Patent: Aug. 20, 2013

(54) PRESSURE INDEPENDENT DROPLET GENERATION

(75) Inventors: Frederikus Johannes Maria de Vreede, Eindhoven (NL); Antonius Paulus Aulbers, Eindhoven (NL); Rene Jos Houben, Nederweert (NL)

(73) Assignee: Nederlandse Organisatie Voor Toegepast-Natuurwetenschappelijk Onderzoek TNO, Delft (NL)

( * ) Notice: Subject to any disclaimer, the term of this patent is extended or adjusted under 35 U.S.C. 154(b) by 66 days.

(21) Appl. No.: 12/997,772

(22) PCT Filed: Jun. 12, 2009

(86) PCT No.: PCT/NL2009/050335

§ 371 (c)(1),
(2), (4) Date: May 2, 2011

(87) PCT Pub. No.: WO2009/151332

PCT Pub. Date: Dec. 17, 2009

(65) Prior Publication Data

US 2011/0211019 A1 Sep. 1, 2011

(30) Foreign Application Priority Data

Jun. 12, 2008 (EP) ..... 08158157

(51) Int. Cl.
*B41J 2/02* (2006.01)
*B41J 2/04* (2006.01)
*B41J 2/07* (2006.01)

(52) U.S. Cl.
USPC ..... 347/73; 347/54; 347/74

(58) Field of Classification Search
None
See application file for complete search history.

(56) References Cited

U.S. PATENT DOCUMENTS

| | | | | |
|---|---|---|---|---|
| 4,138,687 | A | 2/1979 | Cha et al. | |
| 4,528,571 | A | 7/1985 | Sweet | |
| 4,703,330 | A | 10/1987 | Culpepper | |
| 2007/0146442 | A1 * | 6/2007 | Holm et al. | 347/84 |

FOREIGN PATENT DOCUMENTS

| | | | |
|---|---|---|---|
| WO | 02/34526 | A1 | 5/2002 |
| WO | WO 02/34526 | A1 | 5/2002 |

OTHER PUBLICATIONS

Wu, W.D. et al. "Monodisperse Droplet Generators as Potential Atomizers for Spray Drying Technology," *Drying Technology* 2007, 25:1907-1916.

* cited by examiner

*Primary Examiner* — Geoffrey Mruk
(74) *Attorney, Agent, or Firm* — Kilpatrick Townsend & Stockton LLP

(57) ABSTRACT

The invention relates to an apparatus for ejecting droplets of a fluid material, comprising: a reservoir for storing the material, a channel connected with the reservoir, which is provided with at least one outflow opening from which, in use, flows a jet of the material breaking up into droplets, a pump for pressurizing the fluid material in the reservoir, so as to pass the material under pressure through the channel in the direction of the outflow opening, and a movable member provided in the reservoir, the member formed by a plurality of surfaces shaped to induce a pressure variation in the fluid material upstream of the outflow opening, for the purpose of obtaining the jet breaking up into droplets; the movable member mounted to have each opposed surface receiving identical hydrostatic pressure, to generate a net resulting zero force exerted on the movable member by the hydrostatic pressure. Accordingly, a simple mechanism is provided for providing multiple printing nozzles.

18 Claims, 8 Drawing Sheets

50

PRESSURE INDEPENDENT DROPLET GENERATION

This application is a U.S. National Stage of International Application No. PCT/NL2009/050335, filed Jun. 12, 2009, and which claims the benefit of European Patent Application No. 08158157.1, filed Jun. 12, 2008 the entireties of which are incorporated by reference herein.

The invention relates to a droplet break-up device, in the art known as a drop on demand system or a continuous printing system, configured for ejecting droplets from a printing nozzle in various modes. In this respect, the term "printing" generally refers to the generation of small droplets and is—in particular, not limited to generation of images.

In this connection, by a continuous jet printing technique, the continuous generation of drops is meant, which can be utilized selectively for the purpose of a predetermined droplet generation process. The supply of drops takes place continuously, in contrast to the so-called drop-on-demand technique whereby drops are generated according to the predetermined droplet generation process.

A known apparatus is described, for instance, in EP1545884. This document discloses a so-called continuous jet printer for generation of droplets from materials comprising fluids. With this printer, fluids can be printed. During the exit of the fluid through an outlet channel, a pressure regulating mechanism provides a disturbance of the fluid adjacent the outflow opening. This leads to the occurrence of a disturbance in the fluid jet flowing out of the outflow opening. This disturbance leads to a constriction of the jet, which in turn leads to a breaking up of the jet into drops. This yields a continuous flow of egressive drops with a uniform distribution of properties such as dimensions of the drops.

It is desirable to provide a configuration, which can be easily scaled in applied pressure and/or number of outflow openings.

According to an aspect of the invention, an apparatus for ejecting droplets of a fluid material is provided, comprising; a reservoir for storing the material; a channel connected with the reservoir, which is provided with at least one outflow opening, so as to pass the material under pressure through the channel in the direction of the outflow opening from which, in use, flows a jet of the material breaking up into droplets, and a movable member provided in the reservoir, the member formed by a plurality of surfaces shaped to induce a pressure variation in the fluid material upstream of the outflow opening, for the purpose of obtaining the jet breaking up into droplets; the movable member mounted to have each opposed surface receiving identical hydrostatic pressure, to generate a net resulting zero force exerted on the movable member by the hydrostatic pressure.

According to another aspect of the invention, a method of ejecting droplets of a fluid material is provided, comprising: storing the material, in a reservoir, the reservoir comprising a channel connected with the reservoir, which is provided with at least one outflow opening from which, in use, flows a jet of the material breaking up into droplets, pressurizing the fluid material in the reservoir, so as to pass the material under pressure through the channel in the direction of the outflow opening, and mounting a movable member in the reservoir, the member formed by a plurality of surfaces shaped to induce a pressure variation in the fluid material upstream of the outflow opening, for the purpose of obtaining the jet breaking up into droplets; the movable member mounted to have each opposed surface receiving identical hydrostatic pressure, to generate a net resulting zero force exerted on the movable member by the hydrostatic pressure.

Without limitation, frequencies and droplets may be in the order of 5 kHz to 20 MHz, with droplets smaller than 50 micron. Also, multiple outlet channels may be provided, for example, for drying purposes. In addition, by virtue of this arrangement, fluids may be printed having a particularly high viscosity such as, for instance, viscous fluids having a viscosity of $300 \cdot 10^{-3}$ Pa·s when being processed. In particular, the predetermined pressure may be a pressure between 0.5 and 600 bars.

Other features and advantages will be apparent from the description, in conjunction with the annexed drawings, wherein.

Figure 1:
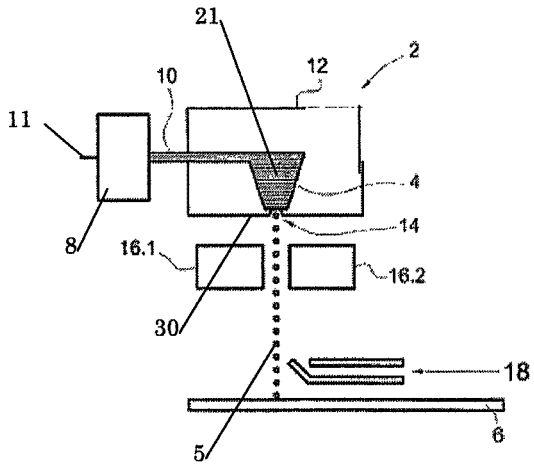
FIG. 1 shows schematically a first embodiment of a droplet generating system for use in the present invention.

FIG. 1 shows schematically a printing apparatus 2 for ejecting droplets of a fluid material 4, in this example, on a plate- or sheet-shaped substrate 6 by means of a continuous jet printing technique. The apparatus 2 comprises a printing head 12, constructed and arranged for printing a printing fluid. In addition, a pressure system 8 is provided comprising a printing fluid inlet 11 and an outlet channel 10.

The channel in the printhead 12 is provided with at least one outflow opening, nozzle 14. The nozzle is arranged in a nozzle plate 30 arranged at the bottom of the reservoir 21. The fluid material 4 exits the nozzle 14 under pressure in the form of a jet 5 breaking up into drops, in order for these drops, after being selectively deflected, or directed, to be printed on the substrate 6. A transverse dimension of the outflow opening 14 can be in the interval of 2-300 micron.

The illustrated apparatus 2 is a printer of the continuous jet-type, whereby a continuous stream of drops to be printed is formed. However, the invention may be also applicable in a drop-on-demand type printer system where drops are delivered through the outflow opening only if the printhead has been activated to that effect. For the purpose of forming a jet 5 breaking up into drops, the apparatus 2 is provided with a pressure regulating mechanism for varying the pressure of the material 4 upstream of the outflow opening further exemplified here below.

For directing the ejected droplet to a predetermined spot, the apparatus 2 may be provided with a directing system 16.1, 16.2 enabling the drops to be deflected in two directions for determining the print location of the drops on the material 6. To that end, the directing system 16.1, 16.2 is provided, for instance, with a charge electrode by means of which the drops can be provided with an electric charge. Also, the directing system 16.1, 16.2 may be provided with, for instance, a capacitor by means of which electrically charged drops can be deflected in their path. Further, the apparatus 2 may be provided with a collecting gutter 18 by which particular drops can be captured, so that these drops are not printed on the substrate 6. Alternatively, the ejected droplets are simply collected in a collector, for example, droplets that are ejected for drying purposes.

The pressure generating means 8 may be constructed for providing a printing pressure in an interval of 0.5-3000 bars. Material 4 having viscosity varying, for instance in a range of 50-800 mPa·s is passed under a predetermined pressure through the channel in the direction of the outflow opening 14. Under this pressure, viscous fluid 4 accommodated in the reservoir is forced through the channel 10 to the outflow opening 14 in the printhead 12. Next, the viscous fluid 4 is forced through the outflow opening 14 to the substrate 6.

Figure 2:
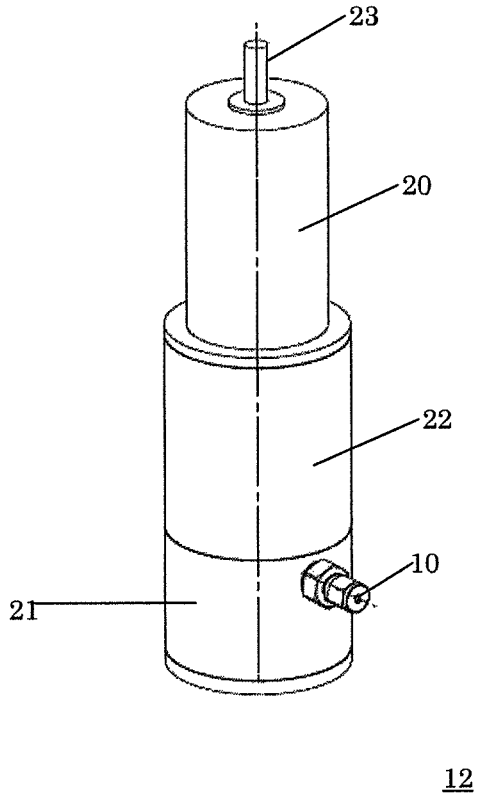
FIG. 2 shows schematically a perspective view of the droplet generating device according to the invention.

FIG. 2 schematically shows a perspective view of the printhead 12 according to an embodiment of the invention. The printhead 12 comprises an actuator 20, for example, comprising a vibrating piezo element or an electrical motor, arranged adjacent the reservoir 21 of the droplet break up device via a bearing section 22. The reservoir 21 comprises a print fluid inlet 10 arranged for receiving pressurized printing fluid. The actuator 20 is mounted via a shaft 23 extends into the reservoir 21 and connects to an oscillating member further illustrated below. When processing hot printing liquids, for example, molten metal at temperatures ranging from 700-1200° C., the shaft extension may provide a thermal barrier protecting the drive motor 20 from excessive heating.

Figure 3A:
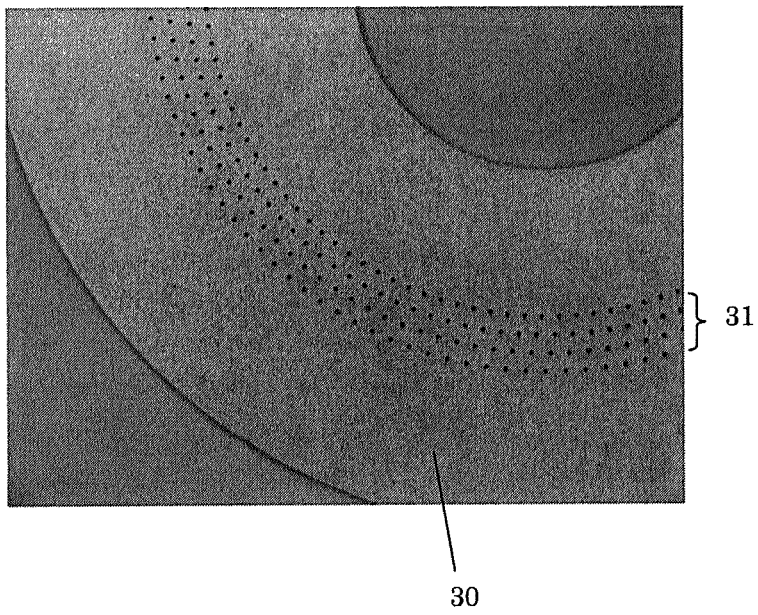
FIG. 3 shows an enlarged partial view of the nozzle plate of the droplet generating device.
Figure 3B:
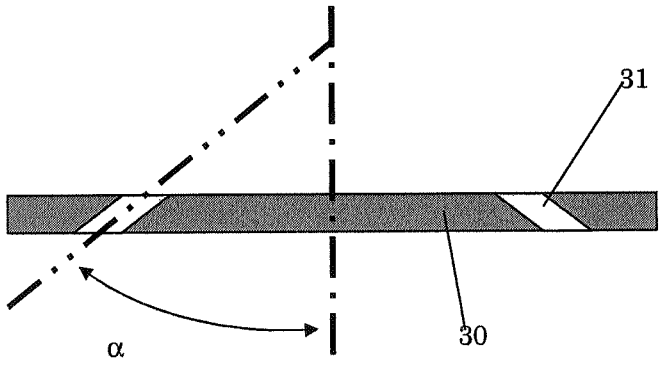

FIG. 3 shows an enlarged partial view of the nozzle plate 30 arranged in the bottom of the reservoir 21 (see FIG. 2), showing a plurality of outlet channels 31. The thickness of the plate is in the interval of 0.05-3 millimeter, but may be typically very small, in particular, for smaller in an interval of 50 micron-500 micron. The outflow channels 31 formed in the bottom plate 30 are oriented at outward directing angles (see FIG. 3B), for example, angles ranging more than 3 degrees away from the normal direction, for example, in a range of 5-85 degrees away from the normal direction. In speate of this very thin nozzle plate a cone of jets 5 can be produced, for example, with a top angle of 40-90 degrees. In the embodiment, the channels were formed by laser drilling. It is noted that it is a surprising effect that with these very small thickness dimensions of around 50-200 micron, jetting under an angle is possible. This considerably eases the construction of the print head 12.

As an exemplary illustration the diameter dimensions of the outlet channel 31 can be in an interval of 2-500 micron, preferably in the order of 5-250 micron, even more preferably between 5-150 micron, depending on the printing liquid substances and the desired droplet size, which may be well below 50 micron. This embodiment has as an advantage that it directs the outlet channels 31 in diverging directions, which can be useful, for example, in industrial spray-drying applications where large volumes of sprays are generated. The embodiment provides a directly controlled generation of droplets in a precisely defined diameter range, which creates monodisperse droplets in predetermined sizes and frequency ranges.

In spray drying applications, this can save considerable energy and costs. In particular, by working with higher viscous fluids, which can be processed with the present multi nozzle system, less drying is needed.

The number of outlet channels 31 can be multiplied along a circumference, which may be 5-500 mm in diameter. For example the number of channels may range from 10-100 and may be oriented in a cone form, for example, 20-500 outlets, spaced at for example 200-800 micron, making large volume production feasible in a simple cost effective way. The system can be easily scaled to higher numbers of outlets, for example, 5000 outlets.

Figure 4:
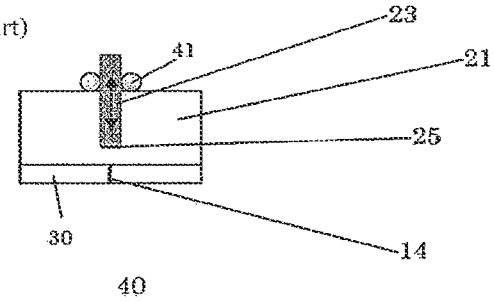
Figure 4 (Prior Art)
FIG. 4 shows a typical prior art viscosity printing system.

In many applications a need exists in the generating of droplets of typically high viscous liquids of a particular, predefined size. As can be seen in FIG. 4, a typical prior art viscosity printing system 40 utilizes a vibrating rod element 23 that is actuated by a piezo element (not shown)—sealed by bearings 41. In this prior art embodiment, the vibrating rod element 23 is shaped so that the hydrostatic pressure is exerted on the piezo element via an axial end side 25. Especially for multi nozzle systems, the effective end side area 25 of the vibrating element 23 will increase, which will induce increasing hydrostatic pressure on the piezo element.

Figure 5:
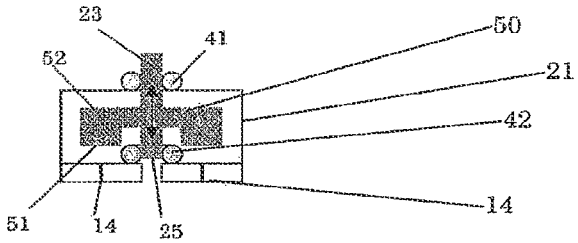
FIG. 5 shows a schematic illustration of the droplet generating device according to an aspect of the invention.

In contrast FIG. 5 shows that, according to an aspect of the invention, the vibrating element (movable member) 50 is mounted to have each opposed surface 51, 52 receiving identical hydrostatic pressure, to generate a net resulting zero force exerted on the movable member 50 by the hydrostatic pressure. Thus, the vibrating element 50 is mounted in a pressure independent way. As a result, no resulting forces are exerted, as a result of increasing hydrostatic pressure, on the actuator, for example provided as a piezo element. Accordingly, as a result, the piezo actuator can move more freely, such that the vibrating energy efficiency is increased, and such that the vibrations can be generated in even higher ranges.

As shown in this FIG. 5, the vibrating member 50 is actuated via an oscillating driving rod 23 that is contacting a piezo oscillating member. According to an aspect, to eliminate the hydrostatic pressure on the driving rod, the movable member is laterally sealed by at least two seals 41, 42, shaped to eliminate hydrostatic pressure on opposed axial end sides 25 of the movable member 23. Typically, these seals can be formed by O-ring seals, additionally functioning as bearings.

The embodiment is particularly suitable for generating high viscosity droplets, having the vibrating element arranged close to the outflow opening 14.

Figure 6:
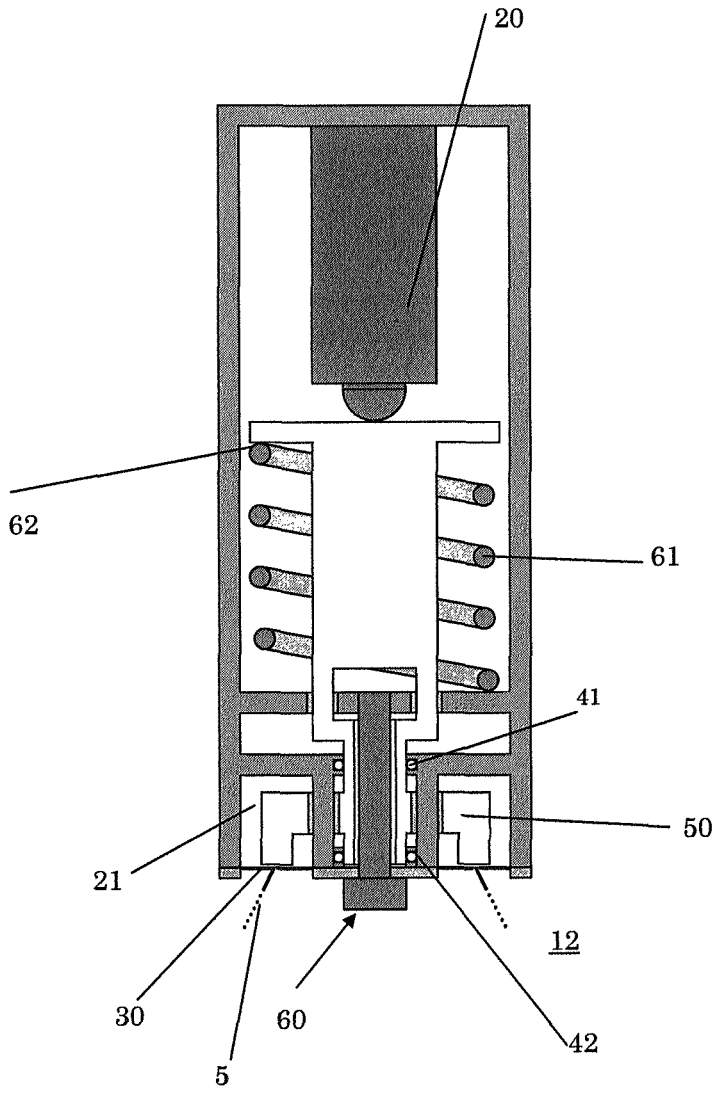
FIG. 6 shows a schematic side view of a further embodiment according to the invention.

FIG. 6 shows a further exemplary embodiment, in particular, showing the nozzle plate 30 annularly arranged around and supported by a central mounting, that secures the plate 30 to a fixed mounting rod 60. In this way, the nozzle plate 30 is prepared against the high pressures in the reservoir 21. In addition, this embodiment features a bias member 61 to bias the movable member 50 against the piezo actuator 20. As an example, in this embodiment, the bias member 61 comprises a compression spring member, mounted against a mounting seat 62 provided on the movable member 50 opposite the actuator 20, for biased pushing of the movable member 50 against the actuator 20.

Figure 7:
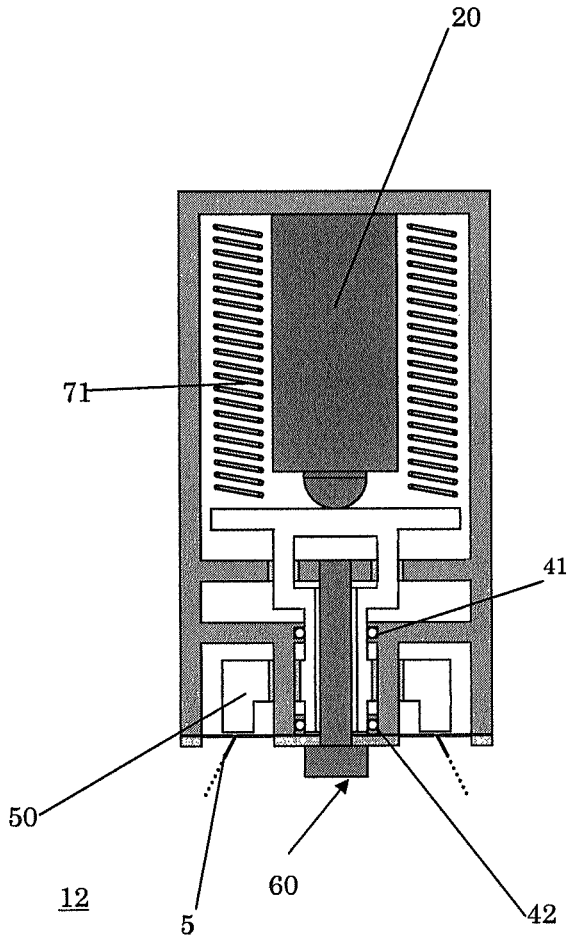
FIG. 7 shows a schematic side view of a further embodiment according to the invention.

FIG. 7 shows a variation of the embodiment of FIG. 6. In this embodiment, the bias member is provided as an extension spring member 71, mounted around the actuator 20, for biased pulling of the movable member 50 against the actuator 20. This embodiment further limits the vibrating mass and reduces the size of the printing head 12.

Figure 8:
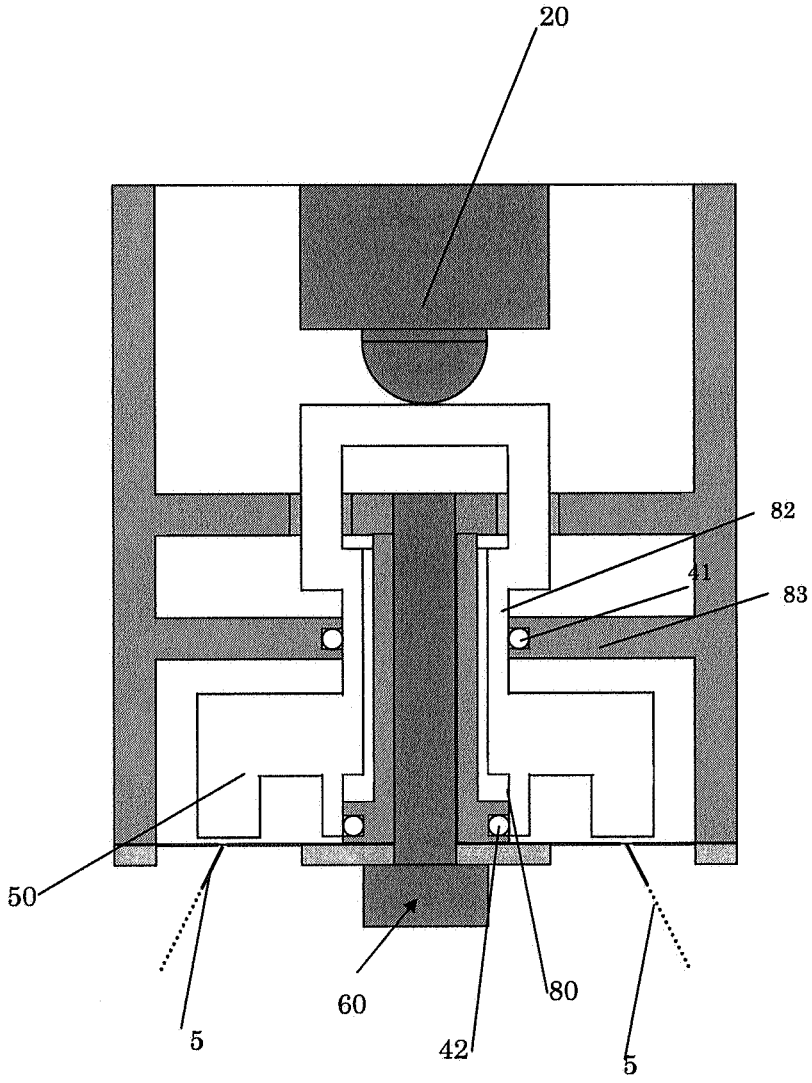
FIG. 8 shows another embodiment according to the invention.

FIG. 8 shows an alternative sealing arrangement, wherein one seal 42 is provided between an inner wall 80 of the movable member 50 and the mounting rod 60; and wherein another seal 41 is provided between an outer wall 82 and the reservoir wall 83.

Figure 9:
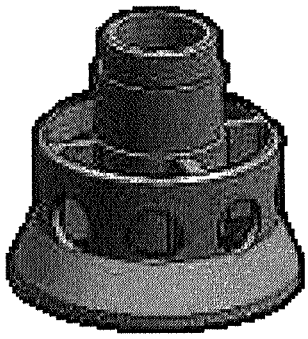
FIG. 9 shows a schematic perspective view of a vibrating member in any of the embodiments of FIG. 6 and FIG. 7 and FIG. 8.

In addition, as shown in FIG. 9, the movable member 50 is provided as a hollow shaped annular element 50 that can move axially with respect to the length axis of the print head 12. The annular element 50 is optimized in reduction of mass, to further optimize the dynamic properties of the print head 12.

The invention has been described on the basis of an exemplary embodiment, but is not in any way limited to this embodiment. In particular, the scope of the invention includes all forms of droplet generation, for example, for spray drying, rapid prototyping or other printing applications. Many variations also falling within the scope of the invention are possible. To be considered, for instance, are the provision of regulatable heating element for heating the viscous printing liquid in the channel, for instance, in a temperature range of 15-1300° C. By regulating the temperature of the fluid, the fluid can acquire a particular viscosity for the purpose of processing (printing). This makes it possible to print viscous fluids such as different kinds of plastic and also metals (such as solder). The method and apparatus according to the invention may be used for spray drying products such as a nutrient or an ingredient therefore, e.g. food, feed and pharmaceutical (for instance: milk) products, solutions of proteins, carbohydrates, fats or combinations thereof. In particular, the invention is also directed to powders produced by the disclosed apparatus. These powders may be characterized by a monodispersity index smaller than 1, preferably smaller than 0.7, more preferably smaller than 0.1. The apparatus may enable to produce powders with less than 5% of the volume of the powder particles consisting of gas and/or voids. Alternatively or in addition, less than 0.1% of the weight of the powder may consist of particles with a diameter smaller than or equal to 250 μm. In one aspect, the powder particles are highly spherical, wherein a centre of mass of the particles is within a distance of 0.8 to 1.2 times the equivalent radius of the particle from the surface of the particle.

Lactose powder may be produced in a crystalline state. In addition, the powder may comprise an emulsified oil containing at least 50 mg/g poly-unsaturated fatty acids.

Alternative products are, however, not excluded. Although in the embodiments, the elastic biasing member comprises a helical spring, other biasing systems, such as hydraulic biasing systems may be feasible. Furthermore, a preferred actuator comprises a piezo element. However, other actuator types, including electrical motors etc. may be used. In addition, the movable member is placed at a predetermined distance of 15-500 micron from the outflow opening, using pressure ranges in the reservoir between 0.5 and 600 bars, more specifically between 100 and 600 bars.

The invention claimed is:

1. An apparatus for ejecting droplets of a fluid material, comprising:

a reservoir for storing the material;

a channel connected with the reservoir, which is provided with at least one outflow opening, so as to pass the material under pressure through the channel in the direction of the outflow opening from which, in use, flows a jet of the material breaking up into droplets, and a movable member provided in the reservoir, the member formed by a plurality of opposing surfaces shaped to induce a pressure variation in the fluid material upstream of the outflow opening, for the purpose of obtaining the jet breaking up into droplets; the movable member mounted to have each of the opposing surfaces in the reservoir receiving identical hydrostatic pressure, to generate a net resulting zero force exerted on the movable member by the hydrostatic pressure.

2. The apparatus according to claim 1, wherein the movable member is laterally supported by at least two sealing bearings, shaped to eliminate hydrostatic pressure on opposed axial end sides of the movable member.

3. The apparatus according to claim 2, wherein the opposed axial end sides are equally in size.

4. The apparatus according to claim 2, wherein the bearings are formed by O-ring seals.

5. The apparatus according to claim 1, wherein the movable member is hollow shaped to be movable along a fixed axis.

6. The apparatus according to claim 5, wherein the reservoir comprises a nozzle plate being secured by the fixed axis.

7. The apparatus according to claim 5, wherein one seal is provided between an inner wall of the movable member and the axis; and wherein another seal is provided between an outer wall and the reservoir wall.

8. The apparatus according to claim 1, further comprising a bias member to bias the movable member against an actuator.

9. The apparatus according to claim 8, wherein the bias member comprises a compression member, mounted opposite the movable member relative to the actuator, for biased pushing of the movable member against the actuator.

10. The apparatus according to claim 8, wherein the bias member comprises an extension member, mounted around the actuator, for biased pulling of the movable member against the actuator.

11. The apparatus according to claim 1, wherein the reservoir comprises a nozzle plate having multiple outflow channels formed therein that are oriented at outward directing angles.

12. Method of ejecting droplets of a fluid material, comprising:

storing the material, in a reservoir, the reservoir comprising a channel connected with the reservoir, which is provided with at least one outflow opening from which, in use, flows a jet of the material breaking up into droplets, pressurizing the fluid material in the reservoir, so as to pass the material under pressure through the channel in the direction of the outflow opening, and mounting a movable member in the reservoir, the member formed by a plurality of opposing surfaces shaped to induce a pressure variation in the fluid material upstream of the outflow opening, for the purpose of obtaining the jet breaking up into droplets; the movable member mounted to have each of the opposing surfaces in the reservoir receiving identical hydrostatic pressure, to generate a net resulting zero force exerted on the movable member by the hydrostatic pressure.

13. Method according to claim 12, wherein the droplets are dried as a powder.

14. Method according to claim 12, wherein the powder has a monodispersity index smaller than 1, preferably smaller than 0.7, more preferably smaller than 0.1.

15. Method according to claim 12, wherein less than 5% of the volume of the powder particles consists of gas and/or voids.

16. Method according to claim 12, wherein less than 0.1% of the weight of the powder consists of particles with a diameter smaller than or equal to 250 μm.

17. Method according to claim 12, wherein the powders comprise lactose.

18. Method according to claim 12, wherein the lactose is in the crystalline state.

* * * * *

UNITED STATES PATENT AND TRADEMARK OFFICE

CERTIFICATE OF CORRECTION

PATENT NO. : 8,511,801 B2
APPLICATION NO. : 12/997772
DATED : August 20, 2013
INVENTOR(S) : de Vreede et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 206 days.

Signed and Sealed this
Fifteenth Day of September, 2015

Michelle K. Lee

Michelle K. Lee
*Director of the United States Patent and Trademark Office*